United States Patent [19]

Fan

[11] Patent Number: 4,834,355

[45] Date of Patent: May 30, 1989

[54] MECHANICAL PROGRAM-CONTROLLED FAST RANGE-ADJUSTING DEVICE

[76] Inventor: Chaolai Fan, 112 Stalin St., Changchun, Jilin Province, China

[21] Appl. No.: 155,294

[22] Filed: Feb. 12, 1988

[30] Foreign Application Priority Data

Sep. 3, 1987 [CN] China ..... 87213118
Nov. 28, 1987 [CN] China ..... 87108067

[51] Int. Cl.[4] ..... B25B 1/02
[52] U.S. Cl. ..... 269/181
[58] Field of Search ..... 269/181–187, 269/179, 173–174

[56] References Cited

U.S. PATENT DOCUMENTS 2,102,602 12/1937 Nash ..... 269/181
2,430,458 11/1947 Farrell ..... 269/189
2,672,776 3/1954 Eisenheimer ..... 269/184

*Primary Examiner*—Robert C. Watson
*Attorney, Agent, or Firm*—Darby & Darby

[57] ABSTRACT

A mechanical program-controlled fast range-adjusting device comprises a locking mechanism for the central shaft, a screw clamp force exerting mechanism and a mechanical program-controlled mechanism. It can be used to adjust the relative position of the movable sliding body quickly according to the different sizes of the workpieces (or their relative positions) so as to realize fastly clamping (or feeding) the workpieces.

8 Claims, 13 Drawing Sheets

H
K
1
2
3
4
5
6
7
8
9
10
11
12
14
15
16
17
18
19
20
21
22
23
24
25
26
27
28
36
37
39
A'
B'
C'
D'
E'
F'
"b"
M
N
O1

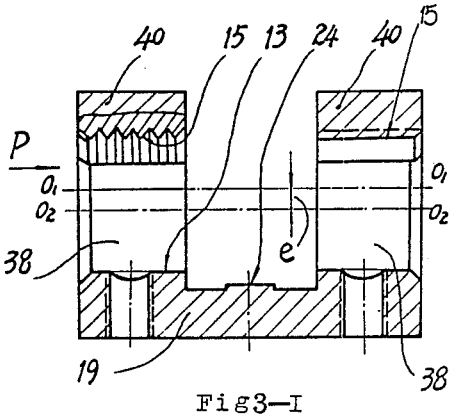
Fig3—I
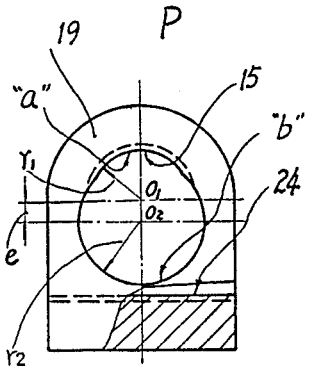
Fig3—II
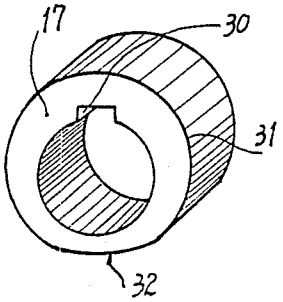
Fig4

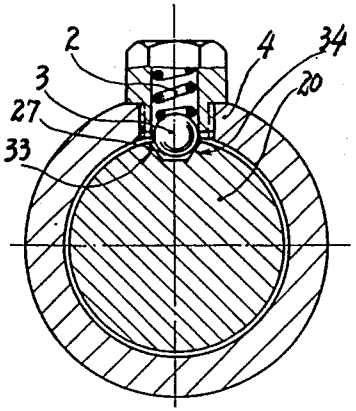
Fig5—I A—A
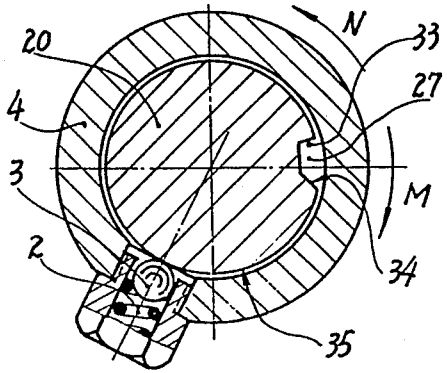
Fig6—I A'—A'
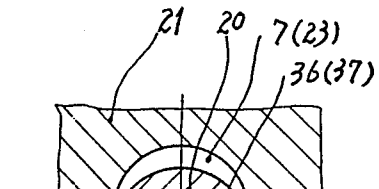
Fig5—II B—B ( F—F )
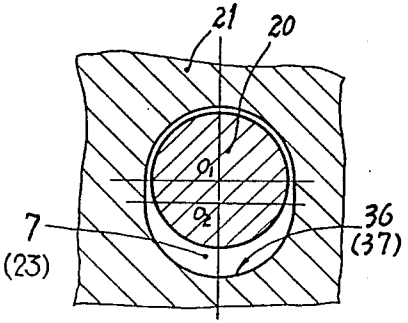
Fig6—II B'—B' ( F'—F' )

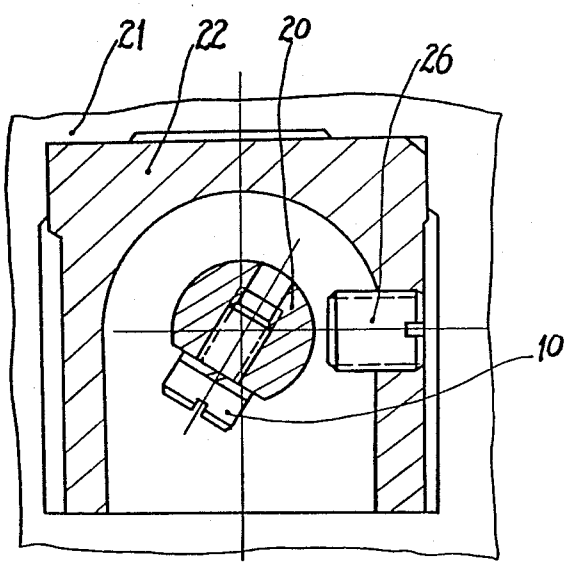
Fig 6 — III C' — C'
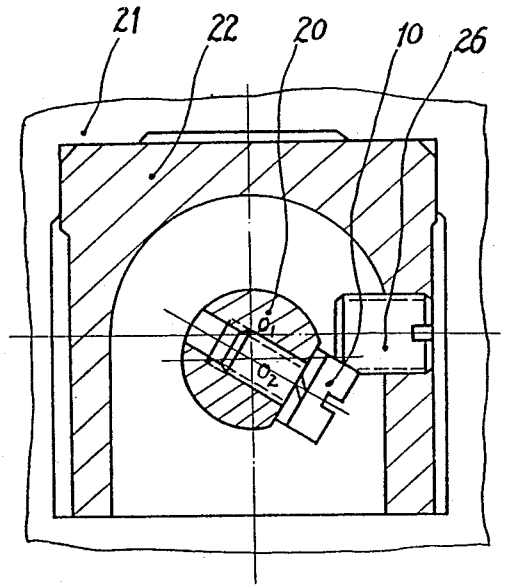
Fig 5 — III C — C

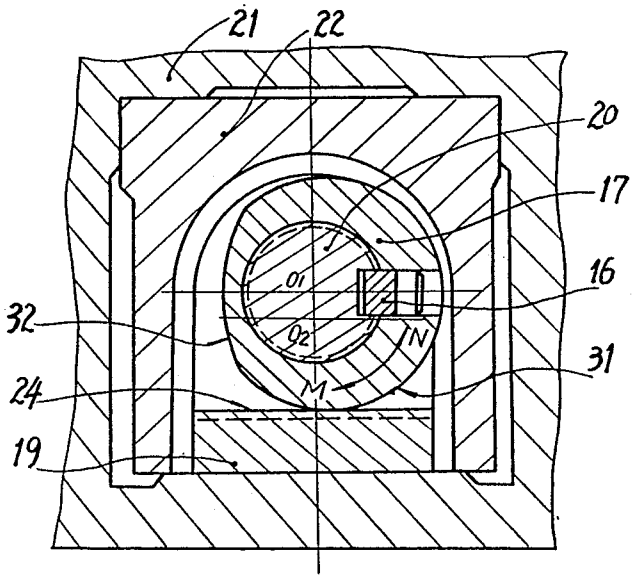
Fig 6 — V E' — E'
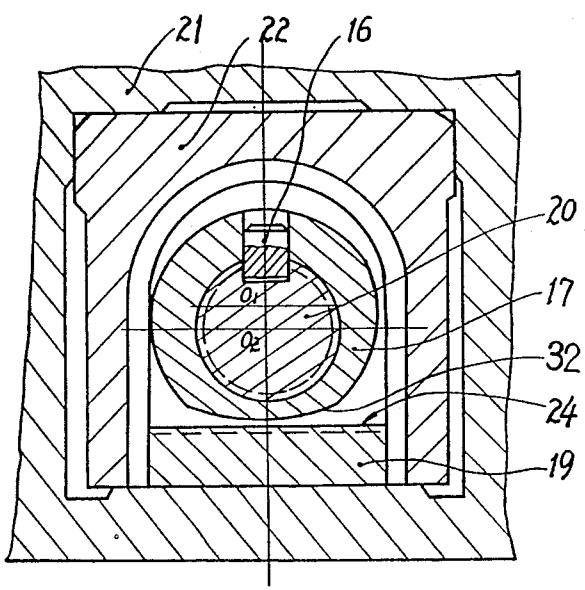
Fig 5-V E — E

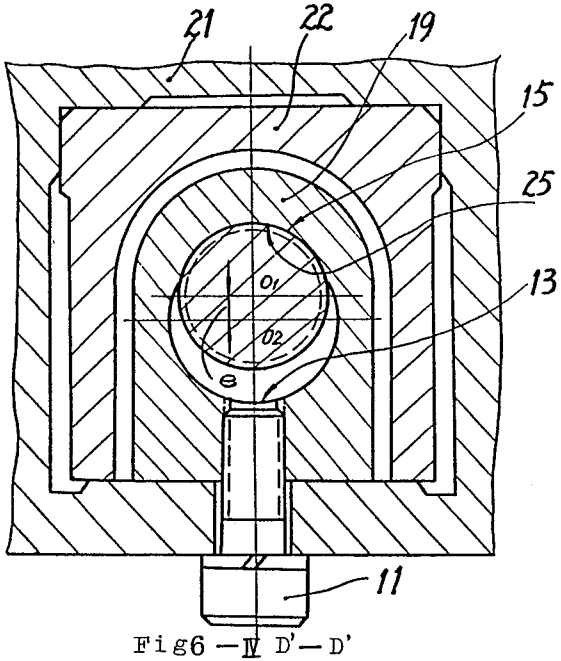
Fig6 — IV D' — D'
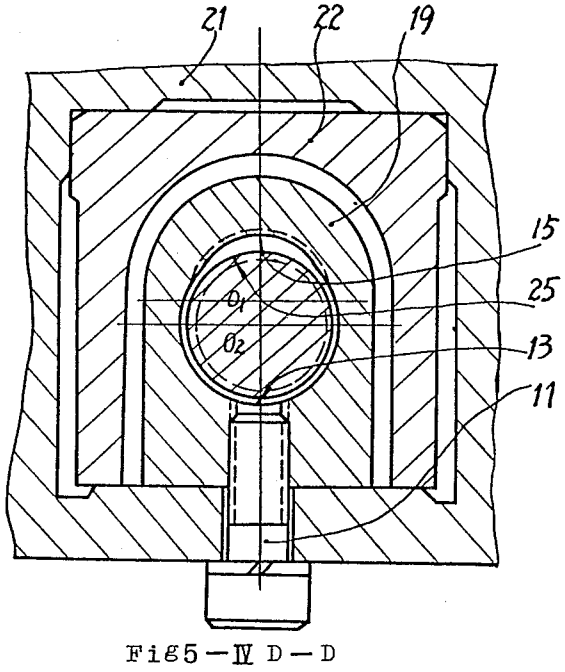
Fig5 — IV D — D

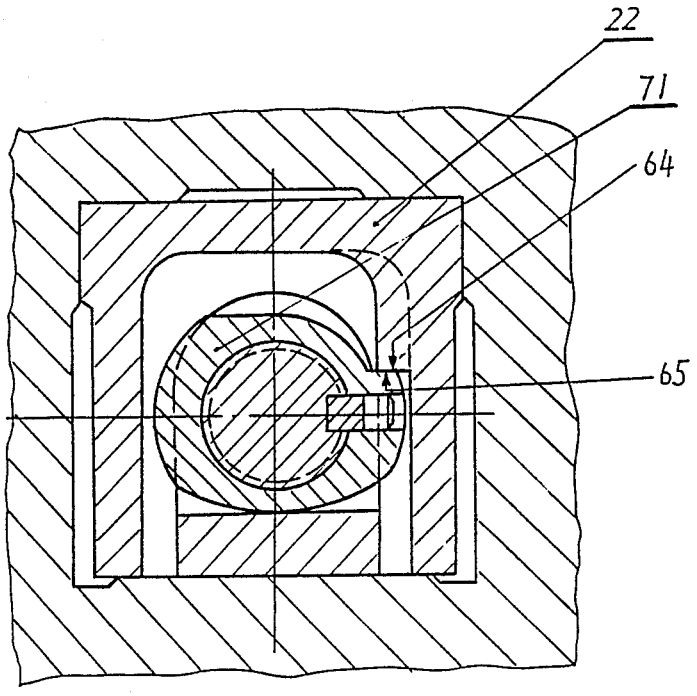
L-L
Fig 9-I

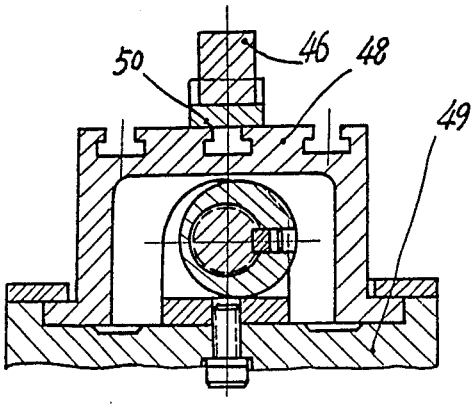
Fig 10—I G—G

MECHANICAL PROGRAM-CONTROLLED FAST RANGE-ADJUSTING DEVICE

This invention relates to a mechanical program-controlled fast range-adjusting device which can be widely used in arrangements such as the bench vices, the machine vices and the sliding worktables in machine tools wherein the workpieces are required to be fast clamped (or fed).

The conventional range-adjusting devices generally use screws and nuts as the driving means. When the distance (or the relative position) between the movable body (or worktable) and the stationary body (or worktable) is required to be adjusted in a large stroke according to different thicknesses (or positions) of the workpieces, the speed in displacement of the movable body relative to the stationary body will be slow hence to decrease the efficiency.

An object of the invention is to overcome the aforesaid drawback through employing a mechanical program-controlled fast range-adjusting device which may quickly adjust the distance (or their relative position) between the two bodies according to the different sizes (or relative positions) of workpieces so as to speed the clamping (or feeding) of the working pieces hence to improve the efficiency.

The fast range-adjusting device according to the invention comprises a stationary body, a movable sliding body, a locking mechanism for a central shaft, a clamp force exerting mechanism and a mechanical program-controlled mechanism. In order to lock the central shaft in any position quickly, an eccentric cam locking mechanism is used; the central shaft is mounted rotablly in the holes of the cam support fixed on the stationary body, said central shaft is provided on itself with a cam, they are connected by the means of a keyway and a guide key; the shape of the holes in the cam support is in the form of a double circular arc; the fitting surfaces between the central shaft and the holes of the cam support are both formed in threads; there are driving threads on left end of the central shaft to engage with the driving threads of a nut on outer of the movable sliding body, said nut is rotated by applying a rotary driving force such that the nut produces an axial displacement to push the sliding body through a plane bearing to clamp workpieces. The device according to the invention employes a mechanical program-controlled arrangement which drives the nut once to lock the central shaft first through the eccentric cam locking mechanism then realize the clamping of workpieces through the driving nut; a positioning pin mounted on the central shaft and a stop pin on the movable sliding body may ensure the eccentric cam in a most relaxed position allowing the central shaft to move along the direction of the axis freely relative to the cam support so as to adjust the distance (or their relative position) between the two bodies arbitrarily with a push-and-pull manner in a very short period according to the thickness of a workpiece for attaining a goal to speed the clamping of the workpiece.

Moreover, because a plane bearing is provided on a contacting surface between the nut and the movable sliding body, the friction in said contacting surface will be decreased hence to decrease the driving moment. Such an advantage is of much interest to manually-operated tools.

The invention will be explained in the following through taking the bench vice as embodiments in referring to the following accompanying drawings.

FIG. 3-I is a front view of the cam support (part sectional).

FIG. 3-II is an end view of the cam support shown in FIG. 3-I.

FIG. 4 is an perspective view of the eccentric cam.

Figure 1:
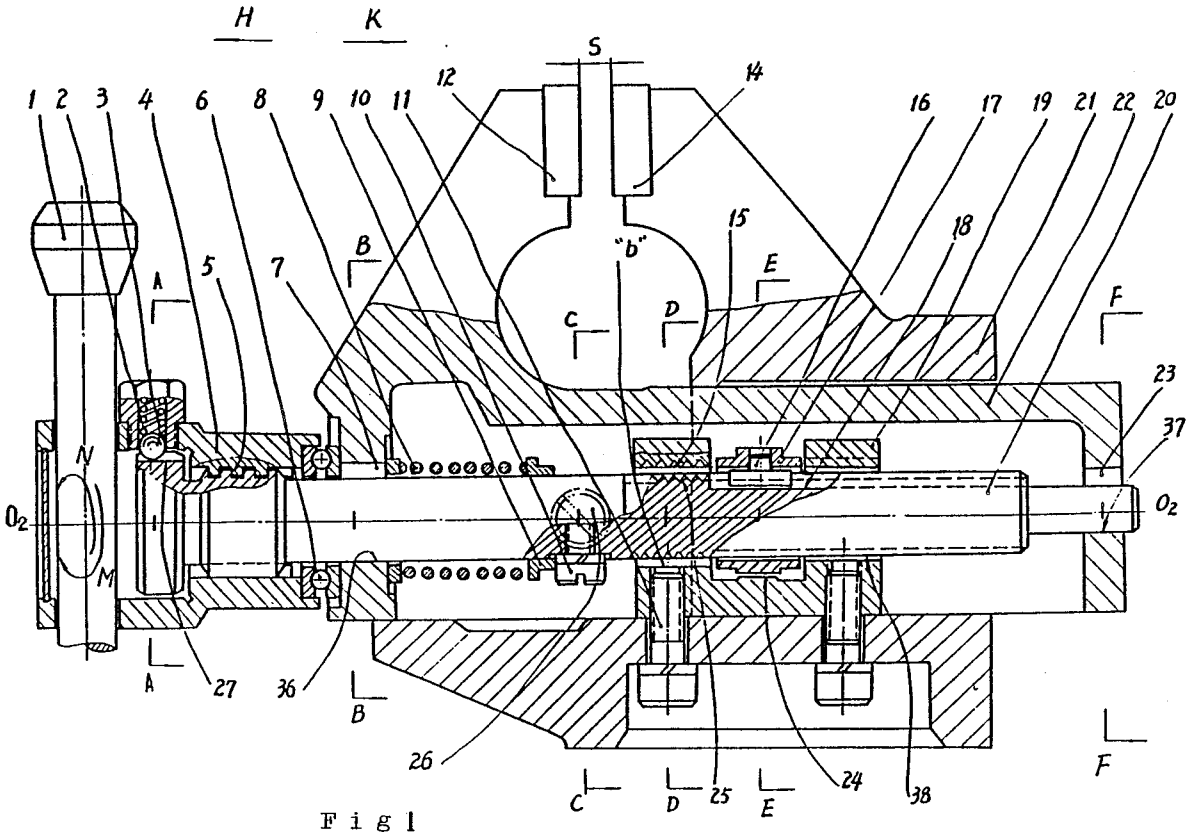
FIG. 1 is a sectional view showing the bench vice employing the fast range-adjusting device according to the present invention with the device in a released position.

FIG. 5-I is a sectional view taken along the line A—A in FIG. 1 showing a relative position of a ball and a recess on the central shaft when the range-adjusting device being in a released position.

FIG. 5-II is a sectional view taken along the line B—B (or F-F) in FIG. 1 showing a relative position of a central shaft journal and the supporting holes in a front vertical plate (or a back vertical plate) of the movable body when the range-adjusting device being in a released position.

FIG. 5-III is a sectional view taken along the line C—C in FIG. 1 showing a relative position of a positioning pin on the central shaft and a stop pin on the movable body when the range-adjusting device being in a released position.

FIG. 5-IV is a sectional view taken along the line D—D in FIG. 1 showing a relative position of the central shaft and the shaft hole in the cam support when the range-adjusting device being in a released position.

FIG. 5-V is a sectional view taken along the line E—E in FIG. 1 showing a relative position of the cam and the cam supporting surface of the cam support when the range-adjusting device being in a released position.

Figure 2:
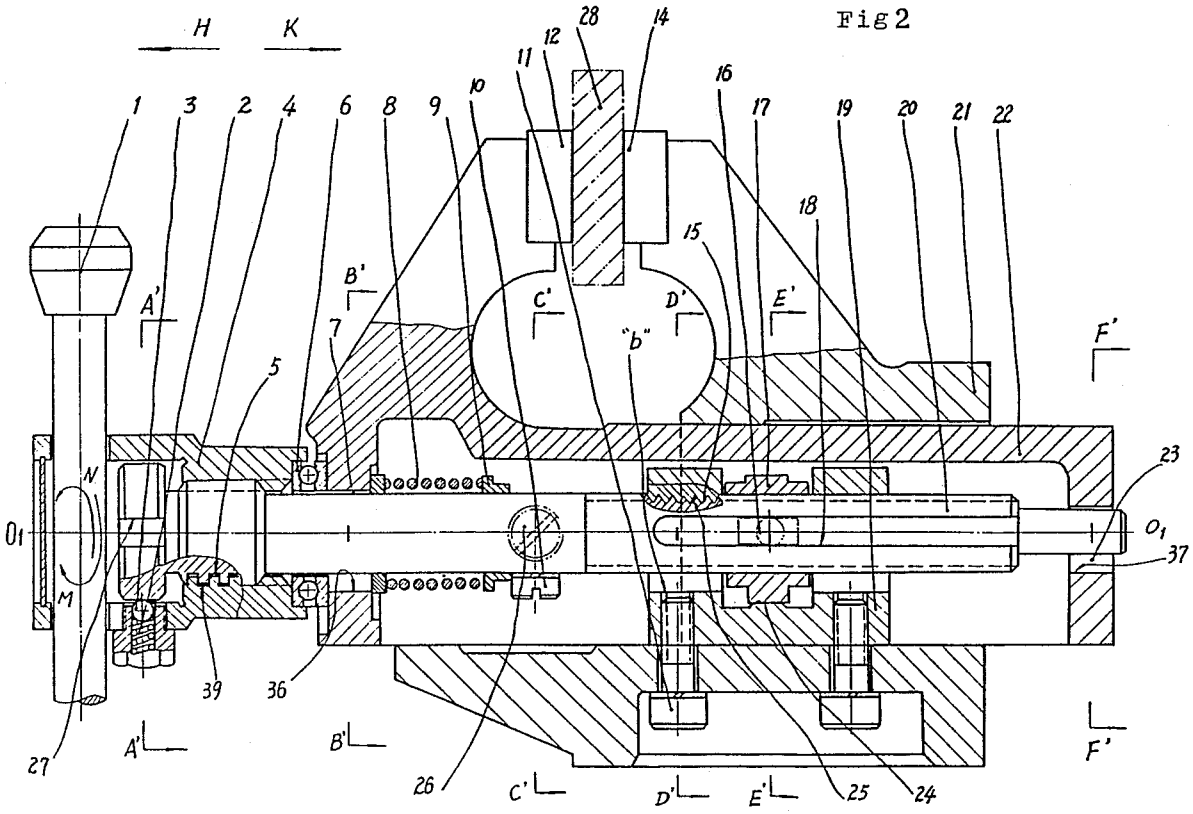
FIG. 2 is a sectional view of the fast range-adjusting device in the bench vice when the device is in a locking position.

FIG. 6-I is a sectional view taken along the line A′—A′ in FIG. 2 showing a relative position of the ball and the recess on the central shaft when the range-adjusting device being in a locking position.

FIG. 6-II is a sectional view taken along the line B′—B′ (or F′—F′) in FIG. 2 showing a relative position of the central shaft journal and the supporting holes in the front vertical plate (or the back vertical plate) of the movable body when the range-adjusting device being in a locking position.

FIG. 6-III is a sectional view taken along the line C′—C′ in FIG. 2 showing a relative position of the positioning pin on the central shaft and the stop pin on the movable body when the range-adjusting device being in a locking position.

FIG. 6-IV is a sectional view taken along the line D′—D′ in FIG. 2 showing a relative position of the central shaft and the shaft hole in the cam support when the range-adjusting device being in a locking position.

FIG. 6-V is a sectional view taken along the line E′—E′ in FIG. 2 showing a relative position of the cam and the cam supporting surface of the cam support when the range- adjusting device being in a locking position.

Figure 7:
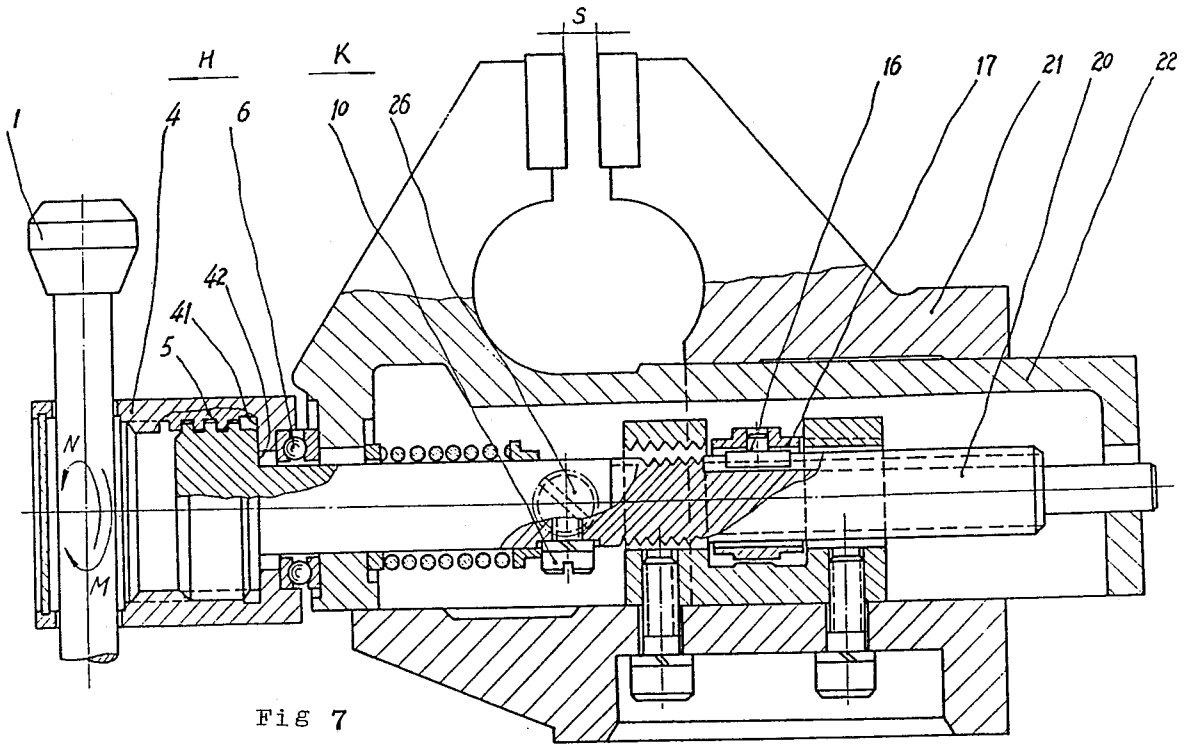
Figure 8:
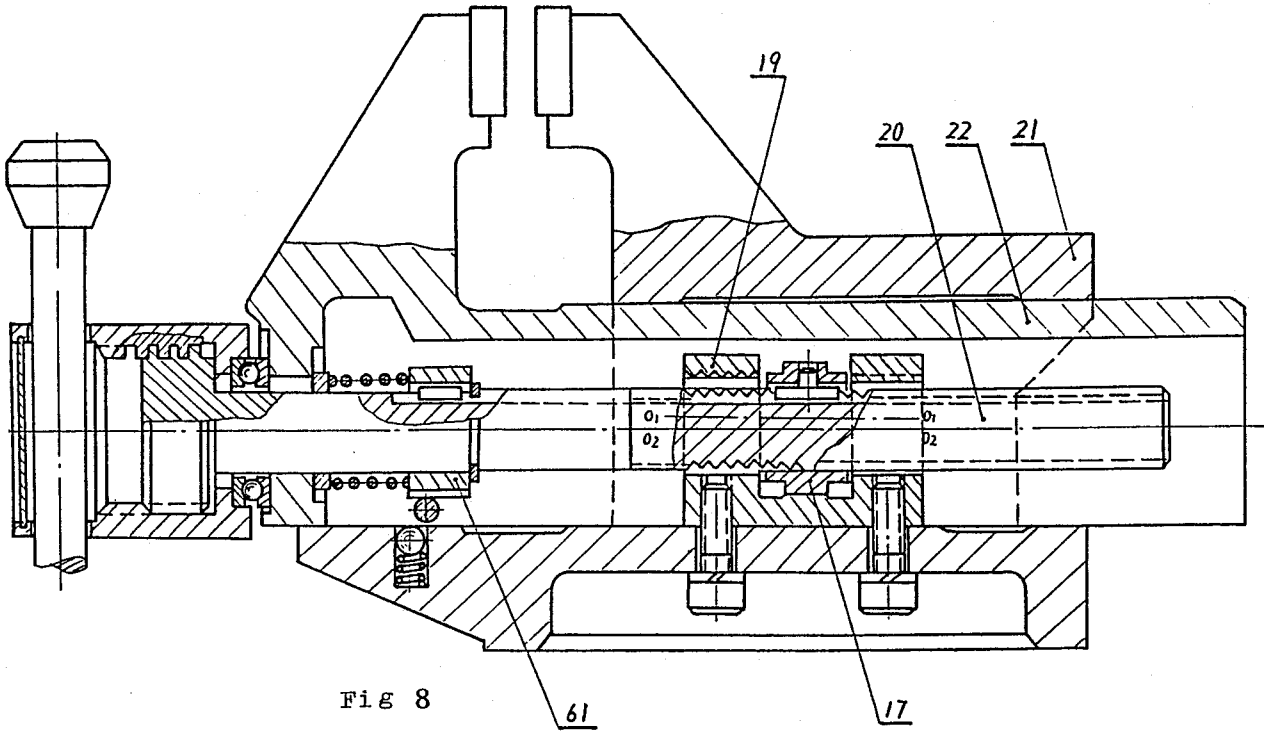
Figure 9:
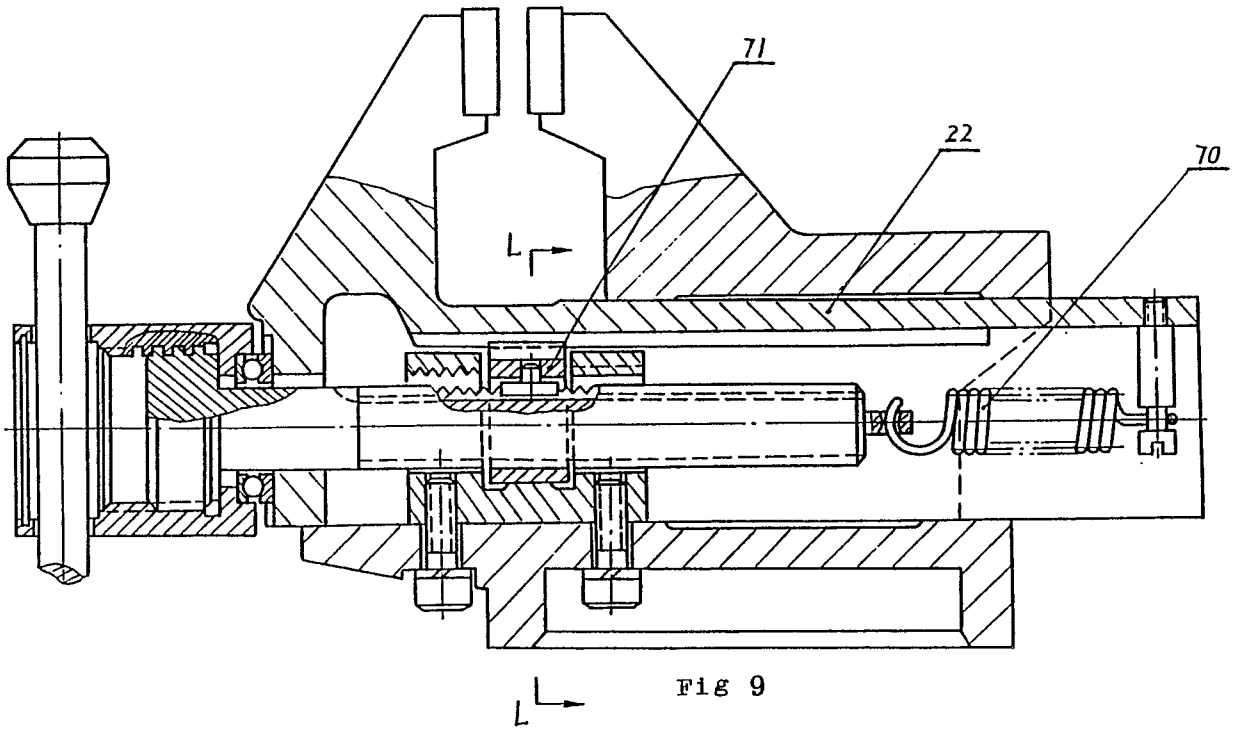

FIG. 7, FIG. 8 and FIG. 9 illustrate several modifications of the bench vice shown in FIG. 1.

FIG. 9-I is a sectional view of Line L—L in FIG. 9.

Figure 10:
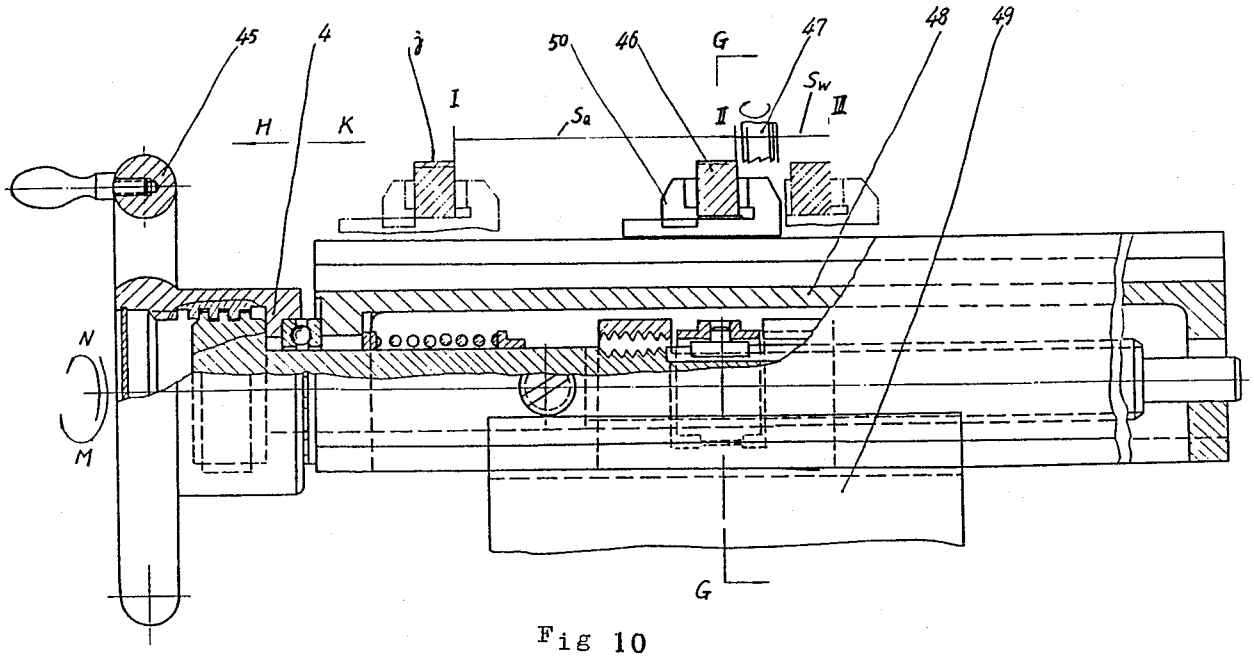

FIG. 10 illustrates the feeding arrangement of workpieces in the miller employing the range-adjusting device according to the invention.

FIG. 10-I is a sectional view of Line G—G in FIG. 10.

FIG. 1 shows the bench vice employing the mechanical program-controlled fast range-adjusting device according to the present invention, comprising the stationary body 21, the movable body 22 able to slide along a guide track in the movable body 22, vice jaws 12 and 14, the locking mechanism for the central shaft, the clamp force exerting mechanism and the program-controlled mechanism; wherein, the locking mechanism for the central shaft comprises the central shaft 20, the cam support 19, the eccentric cam 17, the guide key 16, the positioning pin 10 and the stop pin 26.

The two ends of the central shaft 20 are supported respectively in the supporting holes 7 and 23 on the front and back vertical plates of the movable body 22. The two supporting holes are all long circular holes allowing the central shaft to have a radial movement along a vertical direction. The central shaft is provided on itself with an eccentric cam 17 which has a guide key 19 to fit in a keyway 18 on the central shaft 20. The central shaft 20 extends through two holes 38 in two walls 40 on the cam support 19. In FIG. 1 there are outer locking threads 25 on the central shaft 20 and driving threads 5 on the left end of the central shaft 20.

The cam support 19 is in the form of a saddle (see FIG. 3-I and FIG. 3-II) which is fixed on the stationary body 21 by means of the bolts 11. The two walls 40 on the support 19 have respectively the concentric holes 38. The cross-sectional shape of the holes 38 is formed with two circular arcs, i.e., the upper arc "a" and the lower arc "b" (see FIG. 3-II). The center of circle of the upper "a" is $0_1$ and the central angle of the the arc "a" is less than (or equal to) 180. The radius of the upper arc "a" is $r_1$ which equals to the thread radius of the locking threads on the central shaft 20. The surfaces on the upper arcs "a" of the two holes have respective the inner locking threads 15 which can engage with the outer locking threads 25. The center of circle of the lower arc "b" is $O_2$ which is beneath the center $0_1$ of the upper arc "a" and there is an eccentric distance "e" between the two centers $0_1$and $0_2$. The "e" should be greater than the tooth depth of locking threads 15 and 25. The radius $r_2$ of the lower arc "b" should be greater than the thread radius of the outer locking threads 25 on the central 20.

The eccentric cam 17 is positioned between the two walls 40 of the cam support 19 and is mounted on the central shaft 20 through the guide key 16. The cam 17 is a radial eccentric cam and the curve for the cam is comprised of two portions (see FIG. 4), wherein one portion is a fast upward stroke curve portion 32 and the other portion is a self-locking curve portion 31 of the cam. The design of the two portions of curve should be such that when the central shaft 20 drives the cam 17 to rotate towards the right (the direction of an arrow M in FIG. 6-I), the fast upward stroke curve portion 32 contacts first with the supporting face 24 of the cam support 19, then as the cam 17 continuing in movement causes the central shaft 20 to lift upward vertically allowing the central shaft 20 with its central axial line to lift an distance "e" from a position $0_2$ to a position $0_1$, thus, the outer locking threads 25 on the central shaft 20 will engage preliminarily with the inner locking threads 15 on the surfaces of the arc "a" on the cam support 19, as the central shaft 20 drives the cam 17 to continue its rotation, causing the portion of the self-locking curve 31 to contact gradually with the cam support surface 24 on cam support 19 such that the outer locking threads 25 on the central shaft 20 engages intimately with the inner locking threads 15 on the surface of the upper arc "a" on the hole 38, in the meantime, the cam produces a self-locking action to lock the central shaft 20 with the cam support 19 integrally.

The clamp force exerting mechanism comprises a handle 1, driving nut 4, a plane bearing 6, a compression spring 8 and a gasket 9.

Referring to FIG. 1, the handle 1 is mounted on the driving nut 4 and the driving nut 4 engages with the driving thread 5 on the left end of the central shaft 20; the plane bearing 6 is mounted in the bearing seat of the nut 4; the axial displacement of the nut 4 may push the movable body 22 forward, in the direction of an arrow K in FIG. 1, by the plane bearing to clamp the workpiece 28.

The compression spring 8 is mounted on the central shaft 20 with one end pushing against the inner side of the supporting hole 7 in the movable body 22 and the other end pushing against the pin 10 mounted on the central shaft 20 and the elastic force of the spring 8 holds the movable body 22 permanently to press against the bearing 6.

The mechanical program-controlled arrangement comprises a ball 3, a spring 2 and a recess 27 on the central shaft wherein, the ball 3 and the spring 2 are fixed on the nut 4 by means of a nut cap; the ball 3 is pressed into the recess 27 (see FIG. 5-I) on the left projection of the central shaft 20; one side wall 33 of the recess 27 inclines more steeply to prevent the ball 3 from escaping and its other side wall 34 inclines more gently. The elastic force of the spring 2 should be able to continue to rotate the nut 4 after the locking of the central shaft 20 such that the ball 3 can escape from the recess 27 along the side wall 34 (see FIG. 6-I).

In addition, the movable body 22 is provided with a stop pin 26 and the central shaft 20 is provided with a positioning pin 10, the arrangement of them being such that when the range-adjusting device is released, the central shaft 20 is rotated according to a left-hand direction, shown as the arrow N in FIG. 6-I. and the positioning pin 10 touches with the stop Pin 26 to cease the rotation of the central shaft. Meanwhile, the cam 17 should be kept in a most relaxed state relative to the cam support 19, and there is a gap between the cam 17 and the cam supporting surface 24 on the cam support 19 (see FIG. 5-III and FIG. 5-V).

Now the operation sequences of the mechanical programcontrolled fast range-adjusting device for a bench vice will be explained as follows:

1. The step for the fast adjustment of the opening in the jaw of a bench vice (see FIG. 1)

Now the cam 17 is in a released position (see FIG. 5-V) relative to the supporting surface 24 of the cam support 19. The front end and the back end of the central shaft 20 are supported respectively on the lower supporting surfaces 36 and 37 of the supporting holes 7 and 23 on the front and back verticle plates of the movable body 22 (see FIG. 5-II), meanwhile, the positions of the supporting holes 7 and 23 ensure the axis line of the central shaft to be at the center $0_2$ of the lower arc "b" of the holes 38 while the central shaft 20 does not contact with the inner surfaces in two holes 38 of the cam support 19 in any portion (see FIG. 5-IV), thus the movable body 22 may be pushed or pulled manually such that the movable body 22 may slide quickly along the guide track in the stationary body 21 with the central shaft 20 to fastly adjust the opening S of the vice jaws according to the size of the workpiece.

2. The locking step of the central shaft to the stationary body. (See FIG. 2)

IN accordance with the size of workpiece 28, push the movable body 22 manually, to a suitable position, allow the workpiece 28 to contact with the vice jaw 12 and 14 (see FIG. 2), turn the handle 1 along the right-hand direction, shown as the arrow M in FIG. 1, to rotate the nut 4 in pressing the slope 34 of the recess 27 on the central shaft 20 through the ball 3 on the nut 4, drive the central shaft 20 turning in the direction of the arrow M and the central shaft 20 will in turn drive the cam 17 to rotate in the direction of the arrow M through the guide key 16, then allow the fast upward stroke curve portion 32 to contact with the supporting surface 24 of the cam support 19 and to slide along the supporting surface 24, thus the central shaft 20 will be lifted vertically until the axis line of central shaft lifts from a position at the center $0_2$ of the lower arc "b" to a position at the center $0_1$ of the upper arc "a" through an distance "e" (see FIG. 6-IV), at the same time, the outer locking threads 25 on the central shaft 20 contacts preliminary with the inner locking threads 15 on the inner surfaces of two holes 38 in the cam support 19; when the central shaft 20 drives the cam 17 to move continuously, the self-locking curve portion 31 will gradually contact with the cam supporting surface 24 and cause the outer locking threads 25 of the central shaft 20 to contact intimately with the inner locking thrads 15 on the inner surfaces of two holes 38 (see FIG. 6-IV and FIG. 6-V) until the cam cannot be rotated again, and at the same time, the cam 17 has become in a self-locking condition to lock the central shaft 20 integrally with the cam support 19 and the stationary body 21.

3. The step for clamping a workpiece (see FIG. 2).

When the central shaft 20 is locked integrally with the stationary body 21. continue to turn the handle 1 along the right hand direction, the direction of the arrow M. now the central shaft 20 cannot be rotated again; when the rotative moment is greater than the resistance of the side wall 34 in recess 27 against the ball 3, allow the ball 3 to escape from the recess 27 and to slide on the cylindrical surface 35 of the central shaft 20 along the direction shown as an arrow M in FIG. 6-I, thus to cause the nut 4 able to continue in rotation and produce an axial displacement according to the direction of an arrow K shown in FIG. 1 relative to the central shaft 20, then through the plane bearing 6 to push the movable body 22 forward the clamp the workpiece 28 until a sufficient clamp force has been attained.

To the present, the opening S of the vice jaw can be adjusted in very short time and the aforesaid two steps for locking the central shaft 20 as well as clamping the workpiece 28 may be accomplished continuously by turning the handle 1 once.

4. The step for releasing the workpiece

After the workpiece has been processed and requires to be removed, turn the handle 1 in a left-hand direction shown as the arrow N in FIG. 6-I and cause the nut 4 to rotate relative to the locked central shaft 20 and to move in a axial direction shown as the arrow H in FIG. 1. The spring 8 pushes the movable body to move along the direction of the arrow H together with the nut 4 to enlarge the distance between the vice jaw 12 and 14 for releasing the workpiece 28.

5. The step for releasing the locked central shaft.

Cause the nut 4 to rotate in a left-hand direction (direction of the arrow N) continuously through the handle 1 and drive the ball 3 on the nut 4 to slide along the cylindrical surface 35 on the central shaft 20 according to the direction of the arrow N until the ball 3 falls into the recess 27 under the action of the spring 2 (see FIG. 5-I). The ball 3 pushing against the slide wall 33 with a steeper angle in the recess 27 transmits a driving moment to the central shaft 20 and to the cam 17 through the guide key 16 and the keyway 18 of the central shaft, when the driving moment is greater than the self-locking friction of the cam 17, will drive the central shaft 20 and the cam 17 to rotate along a left-hand direction, direction of the arrow N, and cause both the self-locking curve portion 31 and the fast upward stroke curve portion 32 of the cam 17 to slide along the cam supporting surface 24 of the cam support 19 one after another to bring the cam 17 into a relaxed condition gradually; in the meantime, the central shaft 20 falls from a position in engaging with the inner locking threads 15 of the arc "a" on the cam support 19 (see FIG. 5-IV) until its two ends are supported respectively on the lower supporting surfaces 36 and 37 (see FIG. 5-II) of the supporting holes 7 and 23 in the front and back vertical plates of the movable body 22. Meanwhile, the axis line of the central shaft 20 falls from the center $0_1$ of circle of the upper arc "a" to the center $0_2$ of circle of the lower arc "b" (see FIG. 5-IV) to cause the central shaft 20 without contacting with any portion of the inner surface in two holes 38 of the cam support 19. Since the falling height "e"—the distance between $0_1$ and $0_2$—of the central shaft 20 is greater than the tooth depth of locking threads 15 and 25, the locking threads 15 and 25 can be wholly disengaged. When the central shaft continues to rotate and causes the positioning pin 10 to touch with the stop pin 26 mounted on the movable body 22, there appears a gap between the cam 17 and the cam supporting surface 24 (see FIG. 5-V), which causes the cam 17 in a most relaxed position relative to the cam support 19. Furthermore, the striking force of the positioning pin 10 and the step pin 20 makes the central shaft 20 easy to fall.

Now the central shaft may again move freely along the axial direction to cause the bench vice under a state that its jaw opening can be adjusted arbitrarily, i.e. to restore into the aforesaid state in the first step.

It is Obvious from the described sequences that, since the adoption of the mechanical program-controlled fast range-adjusting device, during the adjustment of the opening S in a vice jaw, through pushing and pulling quickly the movable body 22 and turing the handle 1 once, people can achieve the program control which first lock the central shaft 20 then to clamp the wormpiece in a very short period and the same is true in releasing the workpiece. Thus efficiency is greatly improved.

Moreover, since a plane bearing 6 is provided on the connecting surface between the ut 4 and the movable body 22, the friction resistance in the connecting surface will be decreased hence to decrease the required driving force.

FIG. 7 shows a modification of the bench vice illustrated in FIG. 1, wherein the ball arrangement has been omitted, but an inner end surface 41 is provided on the driving nut 4, which is suitable for contacting with the driving thread end surface 42 of the central shaft 20 for realizing the program control of first locking the central shaft 20 then clamping the workpiece by means of the moment of friction between two end surfaces 41 and 42. During the release of the workpiece, turn the handle 1 in left hand direction (direction of an arrow N), cause the nut 4 to rotate and displace along the direction of an arrow H, the inner end surface 41 presses on the end surface 42, thus, the nut 4 will drive the central shaft to rotate and cause the cam 17 to rotate and release from a self-locking condition; meanwhile, when a rotation of the central shaft 20 causes the positioning pin 10 to strike against the stop pin 26 on the movable body, the central shaft 20 ceases to rotate and the striking force of the positioning pin 10 and stop pin 26 causes the said end surfaces 41 and 42 to be further screwed firmly to produce a pre-fastening force of friction between two end surfaces. When there is a requirement for clamping the workpiece, turn the nut 4 in a right-hand direction, or direction of an arrow M, by means of the handle 1, then the pre-fastening force of friction between the end surfaces 41 and 42 will drive the central shaft 20 to turn together along the direction of the arrow M, and when the cam 17 gets into a self-locking position, the central shaft 20 will be locked. Then the handle 1 drives the nut 4 to rotate continuously and produce an axial displacement along the direction of the arrow K until the movable body 22 is pushed to clamp the workpiece, while two end surfaces 41, 42 are disengaged.

FIG. 8 shows a another modification, a two cam mechanism (17. 61) spaced a distance on the central shaft 20 may be adopted, for making the force acting on the central shaft 20 to be balanced.

FIG. 9. also shows another modification of the bench vice wherein the compression spring 8 shown FIG. 1 is replaced by the extension spring 70 on the end of the central shaft 20. Furthermore, the positioning pin 10 and the stop pin 26 are omitted, while two projected platforms 65 and 64 are formed respectively on the cam 71 and on the movable body 22 (see FIG. 9-I). The effect of the collision and positioning between the two projected platforms are the same as the positioning pin 10 and the stop pin 26 omitted in FIG. 1.

FIG. 10 shows an embodiment illustrating a hand feed miller employing the fast range-adjusting device according the invention, which can achieve a fast feed in idle stroke, a slow feed in "work feed" and a fast retraction after the workpiece has been processed, wherein, it comprises a movable table 48, a miller bed 49, a mill 47, clamper 50 for a workpiece 46, and a hand wheel 45. The workpiece 46 is firmly clamped by the clamper 50 and the clamper 50 is mounted on a T-shaped groove of the movable table 48 (see FIG. 10-I). During the operation, require the movable table 48 with the clamper 50 to load or unload the workpiece 46 at a station I, then require to fast feed an idle stroke $S_q$ to a station II. Subsequently, the movable table 48 loaded with the workpiece 46 begins the "work feed", after the mill 47 processes the surface J of the workpiece 46, the movable table 48 with the processed workpiece 46 attains a station III. Meanwhile, the mill 47 is lifted and the movable table 48 with the processed workpiece 48 retracts quickly to station I, unloading the workpiece and completing an operation cycle. Here the miller employs the fast range-adjusting device according to the present invention. When the movable table 48 carrying the clamping 50 loads the workpiece 46, at the station I, the locking mechanism for the central shaft is under a released condition. After the workpiece has been firmly clamped, quickly push the movable table 48 through a distance $S_q$ to the station II along the direction of the arrow K by means of hand. Then turn the hand wheel 45 in the direction of the arrow M to cause the central shaft locking mechanism of the fast range-adjusting device to lock the central shaft 20 firstly. Subsequently, according to a "work feed" speed as a milling process required, evenly turn the hand wheel 45 along the direction of the arrow M, push the movable table 48 along the direction of the arrow K by a nut and a plane bearing to realize the "work feed" during milling the workpiece. When the workpiece has been processed and moved to the station III with the movable table 48, the mill 47 is lifted, then turn the hand wheel 45 in a left-hand direction, or the direction of the arrow N, to drive the central shaft 20 and the cam 17 in rotation, causing the cam 17 from a self-locking position to a relaxed position to release the locking condition of the central shaft 20, subsequently, manually push the movable table 48 along the direction of the arrow H to cause the movable table 48 carrying the workpiece 46 to quickly retract to the station I and unload the workpiece to accomplish an operation. Thus, achieve the fast feed of workpiece in idle stroke, slow feed during the "work feed", and fast retraction after the workpiece has been processed.

According to the above descriptions, an adoptation of the mechanical program-controlled fast range-adjusting device according to the present invention allows to quickly adjust the distance (or the relative position) between the movable body and the stationary body based on different size of the workpieces or their relative positions, hence to improve efficiency.

The device may have a variety of modifications which should be considered within the scope of the invention.

I claim:

1. A fast adjusting device comprising a stationary body having a hollow portion, a movable body positioned within the hollow portion of the stationary body, said movable body having a receiving member with an aperture of an ellipse type configuration at each end thereof for receiving a central shaft, said central shaft being located within the movable body and having an engaging part at one end thereof, an eccentric cam connected to said central shaft by a guide key, said cam being supported by a cam supporting surface of a cam support, said cam supporting surface being defined by at least two walls, said eccentric cam support stationary positioned within said stationary body, said eccentric cam positioned between said two walls, said cam and said two walls of the cam support having an opening going therethrough, a driving unit connected at one end of said central shaft, said shaft passing through the opening in the cam and the walls of the cam support, said ellipse type apertures of said receiving members support said ends of the central shaft, whereby during operation of the device said central shaft moves linearly along a longitudinal axis of said ellipse type apertures.

2. A fast adjusting device according to claim 1, wherein said central shaft has locking threads along its outside surface, said openings in the walls of the cam support are concentric, a cross-section of each said opening consists of at least first and second substantially circular arcs, a central angle of the first arc is no more than 180° and its radius being substantially equal to a radius of said locking threads of the central shaft, an inside surface of the first substantially circular arc having inner locking threads adapted for engagement with the outer locking threads of the central shaft;

a center of the second substantially circular arc being positioned below a center of the first circular arc and a radius of the second circular arc being greater than the radius of the outside locking threads of the central shaft, a distance between the centers of the first and second substantially circular arcs being greater than the depth of the locking threads.

3. A fast adjusting device according to claim 1, wherein said eccentric cam is a radial eccentric cam, a curvature of the eccentric cam includes a fast upward stroke curved portion and self-locking curved portion, the curvature of the cam sliding along said cam supporting surface of the cam support, whereby during operation of the device said fast upward stroke curved portion is adapted to move the central shaft substantially upwardly causing the outer locking threads of the central shaft to engage the inner locking threads on the surface of the first circular arc, said self-locking curved portion is adapted to lock the central shaft and the cam support integrally, said eccentric cam through its guide fits within a key way on the central shaft.

4. A fast adjusting device according to claim 1, wherein bearing means is provided on an outside surface of the central shaft between the driving unit and the movable body.

5. A fast adjusting device according to claim 1 further comprising a movable jaw attached to said movable body and a stationary jaw attached to the stationary body.

6. A fast adjusting device according to claim 5, wherein an extension spring is adapted at one end of the central shaft.

7. A fast adjusting device according to claim 5, wherein a positioning platform is formed on the cam and the movable body.

8. A fast adjusting device according to claim 3, wherein the central shaft drives the eccentric cam to rotate in one direction so that the fast upward stroke curved portion contacts the supporting surface of the cam support, the cam continues the rotation causing the central shaft to be lifted substantially upwardly allowing the central shaft with its central axis line to be lifted to a predetermined distance, thus the outer locking threads on the central shaft engage firstly with the inner locking threads on the surfaces of the arc on the cam support as the central shaft drives the cam to continue its rotation causing the portion of the self-locking curved to contact gradually the cam support surface of the cam support in such a manner that the outer locking threads on the central shaft engage with the inner locking threads on the surface of the first arc causing the cam to produce a self-locking action and to lock the central shaft with the cam support.

* * * * *